United States Patent [19]

Smith

[11] Patent Number: 4,580,204

[45] Date of Patent: Apr. 1, 1986

[54] LAMP REFLECTOR AND LAMP ASSEMBLY

[75] Inventor: Alan K. Smith, Cannock, England

[73] Assignee: Lucas Industries public limited company, Birmingham, England

[21] Appl. No.: 662,026

[22] Filed: Oct. 18, 1984

[30] Foreign Application Priority Data

Oct. 22, 1983 [GB] United Kingdom ..... 8328308

[51] Int. Cl.[4] ..... F21V 7/10

[52] U.S. Cl. ..... 362/346; 362/297

[58] Field of Search ..... 362/219, 236, 332, 346, 362/360, 80, 297

[56] References Cited

U.S. PATENT DOCUMENTS

| | | | |
|---|---|---|---|
| 2,408,783 | 10/1946 | Kloner | 362/219 |
| 2,818,497 | 12/1957 | Alden | 362/219 |
| 4,189,709 | 2/1980 | Gosswiller | 362/332 X |

FOREIGN PATENT DOCUMENTS

| | | | |
|---|---|---|---|
| 2162147 | 6/1973 | Fed. Rep. of Germany . | |
| 2656755 | 6/1978 | Fed. Rep. of Germany . | |
| 2145246 | 2/1973 | France . | |
| 2314843 | 1/1977 | France . | |
| 2320210 | 3/1977 | France . | |
| 14770 | of 1905 | United Kingdom | 362/219 |

*Primary Examiner*—Tony M. Argenbright

*Attorney, Agent, or Firm*—Leydig, Voit & Mayer, Ltd.

[57] ABSTRACT

To facilitate production of a variety of lamp assemblies using a reduced amount of tooling, a lamp assembly is formed of a first reflector body having an internal reflective surface and at least one second reflector body having an internal reflective surface which are secured together by rivets rather than being moulded together to form a particular design of lamp assembly. Complementary frusto-conical bosses and recesses are formed at one side of the respective bodies, as are complementary stepped portions, in order to ensure that the bodies are secured together with the reflective surface in the required mutual disposition.

16 Claims, 2 Drawing Figures

LAMP REFLECTOR AND LAMP ASSEMBLY

Figure 1:
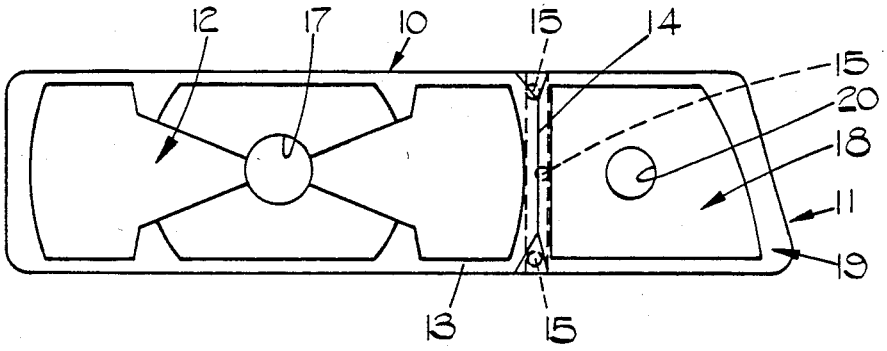

This invention relates to a lamp and is more particularly concerned with a lamp assembly and a reflector therefor. Because of varying motor vehicle styling requirements, a very wide variety of different designs and configurations of lamp assemblies are required for motor vehicles, both for the headlamp assemblies at the front of motor vehicles and for the tail lamp assemblies at the rear of motor vehicles. This requires a great variety of tooling to enable the full range of lamp assemblies to be manufactured.

An object of the present invention is to provide a design of reflector and lamp assembly which enables a variety of different configurations to be produced with a reduced amount of tooling.

According to the present invention, there is provided a lamp reflector comprising a dished body having an internal reflective surface, and means disposed at at least one side of the body to enable a further reflector body to be secured thereto so that the reflective surfaces of the reflector bodies are in the required mutual disposition.

Also according to the present invention there is provided a lamp assembly comprising a first reflector body having an internal reflective surface, at least one second reflector body having an internal reflective surface, and means securing the first reflector body to said at least one second reflector body, said securing means being disposed at at least one side of the first reflector body and being arranged to retain the reflective surfaces of the first and second reflector bodies in the required mutual disposition.

Preferably, said securing means includes complementary male and female formations on the reflector bodies, and at least one retainer element serving to fasten said reflector bodies together with the male and female formations in inter-engagement.

Preferably also, the complementary male and female formations comprise at least one spigot on one of the reflector bodies and at least one complementary recess on the or each of the other reflector bodies.

Preferably, the or each spigot and the complementary recess are correspondingly tapered.

Most preferably, the or each spigot is in the form of a frusto-conical boss and the or each recess is a frusto-conical recess.

Conveniently, the or each retainer element passes through the or a respective one of the spigots and the complementary recess.

The or each recess is preferably defined by a cup-shaped portion on one of the reflector bodies.

The or each retainer element is preferably in the form of a rivet.

The reflector bodies are preferably formed of a low profile, thermosetting polyester, dough moulding composition. Such a material can be moulded sufficiently accurately to ensure that the bosses and recesses are reproduced consistently in the required disposition relative to the reflective surfaces in the reflector bodies of which they form part, whereby to ensure that the reflective surfaces are held accurately and consistently in the required mutual disposition when the bodies are secured together.

Figure 2:
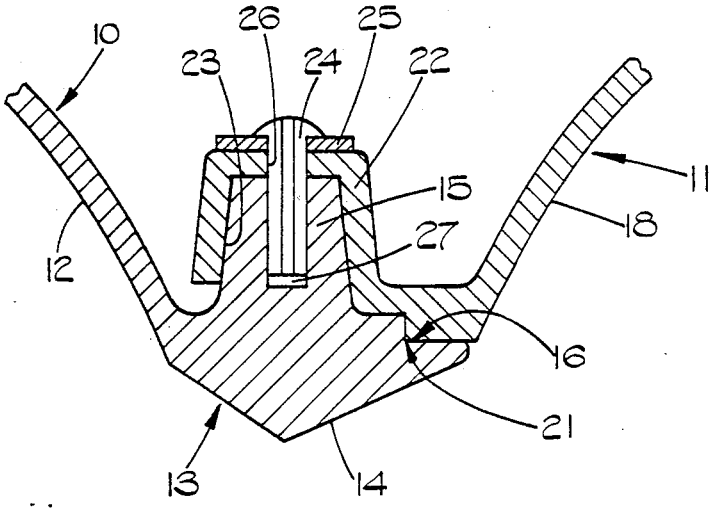

An embodiment of the present invention will now be described, by way of example, with reference to the accompanying drawing in which:

FIG. 1 is a front view of a lamp assembly according to the present invention, and FIG. 2 is a cross-section of a detail of the assembly of FIG. 1, shown on a larger scale.

Referring now to the drawing, the lamp assembly illustrated therein is a motor vehicle headlamp assembly although the invention is also applicable to lamp assemblies generally, including motor vehicle tail lamp assemblies. The headlamp assembly includes a first or main reflector body 10 and a second reflector body 11. The main reflector body 10 is of dished form and defines an internal surface 12 which is coated with a thin, vacuum-deposited aluminium film to render it reflective. In this embodiment, the internal surface 12 defines a plurality of reflective portions having a common focus. However, the invention is applicable to reflector bodies having a single reflective surface portion. The main reflector body 10 is injection moulded out of a low profile, thermosetting unsaturated polyester dough moulding composition containing 15% by weight of glass fibres.

The reflector body 10 includes a surrounding flange 13. The flange 13 on the right hand side of the body 10 (as viewed in FIG. 1) has a front surface 14 of tapered ridge-like form (see FIG. 2). The rear surface of the right hand side of the flange 13 is formed with a series of three frusto-conical bosses 15 extending rearwardly therefrom two of the bosses 15 are disposed at opposite ends of the right hand side of the rear surface of the flange 13 whilst the third boss 15 is disposed intermediate the ends of the right hand side of the flange 13. The rear surface of the right hand side of the flange 13 is also formed with a stepped portion 16 which extends for the complete length thereof and which is disposed outwardly of the bosses 15.

The body 10 is provided with a rear aperture 17 which receives, in use, a bulb carrying a passing-beam filament (not shown). The internal surface 12 of the body 10 is configurated so as to provide a passing beam pattern in use.

The left hand side of the flange 13 may carry formations thereon corresponding to the formations 14, 15 and 16 or it may be moulded without any one or more of such formations. It will be appreciated, however, that it will be normal practice to design mould tooling which is capable of producing the formations 14, 15 and 16 on both sides of the flange 13 and for appropriate parts of the tool to be blanked off as necessary so that the same tool can be used for moulding a main reflector body suitable for having a second reflector body 11 secured thereto at either or both sides thereof.

The second reflector body 11 is injection moulded from the same material as that from which the reflector body 10 is formed. The second reflector body 11 is of dished form and has an internal surface 18 which is rendered reflective in a like manner to internal surface 12 described above. The second reflector body 11 is also provided with a surrounding flange 19 and with a rear aperture 20 which receives a bulb (not shown) having a driving beam filament. The left hand side of the flange 19 has a stepped portion 21 extending completely along its length, the stepped portion 21 being of complementary form to that of the stepped portion 16. The flange 19 is also provided with a series of three cup-shaped portions 22 at corresponding positions to the bosses 15. The cup-shaped portions 22 have their openings presented to the front of the body 11. Each cup shaped portion 22 defines an internal recess 23 which is of complementary frusto-conical form to that of the external surface of the respective boss 15.

The bodies 10 and 11 are held together by retainer elements in the form of three rivets 24. Each rivet 24 is provided with a washer 25 and extends through a hole 26 in the base of the cup-shaped portion 22 and into a blind recess 27 in the respective boss 15. Each hole 26 and respective boss 27 are in alignment.

Because the bosses 15 and the internal surface 12 are formed in the same moulding operation from low profile material and because the internal surface 18 and the cup-shaped portions 22 similarly formed, the precise relative positions of the bosses 15 and the surface 12 and the surface 18 and the cup-shaped portions 22 can be very accurately controlled, and therefore the mutual dispositions of the surfaces 12 and 18 can be very accurately controlled. The stepped portions 16 and 21 also assist in ensuring that the rivets 24 hold the reflector bodies 10 and 11 together with the reflective surfaces 12 and 18 in the required mutual disposition. It will be appreciated that it is very important to ensure that lamp assemblies can be manufactured with the surfaces 12 and 18 in the required mutual dispositions since this enables the required angular relationship of the headlamp beams under passing and driving beam conditions to be achieved consistently in mass production.

The invention is applicable, mutatis mutandis, to constructions where three or more reflector bodies are to be secured together.

I claim:

1. A lamp assembly comprising a dished first reflector body having an internal reflective surface and an integrally formed flange which is provided around said first body, a dished second reflector body having an internal reflective surface and an integrally formed flange which is provided around the second reflector body, and means for securing said first body to said second body, said means comprising at least one pair of male and female formations in interengagement, one formation of said at least one pair being formed integrally with a part of said flange around said first body and the other formation of said at least one pair being formed integrally with a part of said flange around said second body, and said parts of said flanges being mutually overlapping.

2. A lamp assembly as claimed in claim 1 wherein said securing means includes complementary stepped portions on said mutually overlapping parts of said flanges.

3. A lamp assembly as claimed in claim 1 wherein said male formation is a spigot and said female formation is a complementary shaped recess.

4. A lamp assembly as claimed in claim 3 wherein said spigot and said recess are correspondingly tapered.

5. A lamp assembly as claimed in claim 1 wherein said male formation of said pair is formed on said flange around said first body and said female formation of said pair is formed on said flange around said second body.

6. A lamp assembly as claimed in claim 1 wherein said means for securing said first body to said second body further includes at least one retainer element serving to fasten said bodies together.

7. A lamp assembly as claimed in claim 6 wherein said at least one retainer element passes through a respective male and female formation.

8. A lamp assembly as claimed in claim 6 wherein said at least one retainer element is a rivet.

9. A lamp assembly as claimed in claim 6 wherein at least one retainer element passes through at least one boss and its complementary recess.

10. A lamp assembly as claimed in claim 6 wherein at least one retainer element is in the form of a rivet.

11. A lamp assembly as claimed in claim 1 wherein said securing means comprise two spaced pairs of male and female formations in interengagement.

12. A lamp assembly comprising a first dished body having an internal forward facing reflective surface and an integrally formed flange which is provided around said first body, a second dished body having an integrally formed flange provided around said second body and an internal forward facing reflective surface, and means for holding said bodies together so that the reflective surfaces of the reflector bodies are in a required mutual disposition, including a first formation on one side of said first body formed integral with said flange around said first body and facing rearwardly, a second formation having a complementary shape to said first formation and formed integral with said flange around said second body and facing forwardly so as to interengage with said first formation, and an elongated stepped formation on said one side of said first body interengaging a complementary stepped formation on one side of said second body, said interengaging formations securing the bodies in fixed relationship with each other.

13. A lamp assembly as claimed in claim 12 wherein the complementary formations comprise a boss on said first reflector body and a complementary recess on said second reflector body.

14. A lamp assembly as claimed in claim 13 wherein at least one boss and the complementary recess are correspondingly tapered.

15. A lamp assembly as claimed in claim 13 wherein at least one boss is in the form of a frusto-conical boss and at least one recess is a frusto-conical recess.

16. A lamp assembly as claimed in claim 13 wherein at least one recess is defined by a cup-shaped portion on one of the reflector bodies.

* * * * *